US006836930B2

(12) United States Patent
Thur et al.

(10) Patent No.: US 6,836,930 B2
(45) Date of Patent: Jan. 4, 2005

(54) AIRFLOW INDICATOR

(75) Inventors: Charles J. Thur, Broadview Heights, OH (US); Mark E. Cipolla, Chardon, OH (US); Craig Barbeck, North Royalton, OH (US); Steven J. Paliobeis, Painesville, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 356 days.

(21) Appl. No.: 10/044,572

(22) Filed: Jan. 11, 2002

(65) Prior Publication Data

US 2004/0098823 A1 May 27, 2004

Related U.S. Application Data

(63) Continuation-in-part of application No. 09/590,088, filed on Jun. 7, 2000, now Pat. No. 6,467,123.

(51) Int. Cl.[7] ..... A47L 9/19
(52) U.S. Cl. ..... 15/339; 15/347
(58) Field of Search ..... 15/339, 347; 116/268

(56) References Cited

U.S. PATENT DOCUMENTS

| | | | | |
|---|---|---|---|---|
| 2,184,421 A | | 12/1939 | Gerber | 116/266 |
| 2,353,621 A | | 7/1944 | Replogle | 15/339 |
| 2,908,283 A | | 10/1959 | Kiffer et al. | 137/269.5 |
| 3,253,295 A | | 5/1966 | Waters | 15/339 |
| 3,279,418 A | | 10/1966 | Nilsson | 116/70 |
| RE26,235 E | | 7/1967 | Woodford | 137/218 |
| 3,333,564 A | | 8/1967 | Waters | 116/268 |
| 3,587,515 A | | 6/1971 | Anderson | 116/60 |
| 3,678,882 A | | 7/1972 | Kinsella | 116/268 |
| 3,766,595 A | | 10/1973 | Valbona et al. | 15/339 |
| RE28,268 E | | 12/1974 | Autrand | 116/67 R |
| 3,936,904 A | | 2/1976 | Bashark | 15/339 |
| 4,015,308 A | | 4/1977 | Rickmers | 15/339 |
| 4,020,525 A | | 5/1977 | Fromknecht et al. | 15/339 |
| 4,060,050 A | * | 11/1977 | Simonsson | 116/268 |
| 4,124,916 A | | 11/1978 | Fromknecht | 15/339 |
| 4,294,595 A | | 10/1981 | Bowerman | 96/403 |
| 4,733,430 A | | 3/1988 | Westergren | 15/339 |
| 4,833,753 A | | 5/1989 | Müller | 15/339 |
| 4,991,745 A | | 2/1991 | Brown | 222/212 |
| 5,033,655 A | | 7/1991 | Brown | 222/212 |
| 5,213,236 A | | 5/1993 | Brown et al. | 222/212 |
| 5,339,995 A | | 8/1994 | Brown et al. | 222/173 |
| 5,377,877 A | | 1/1995 | Brown et al. | 222/105 |
| 5,396,925 A | | 3/1995 | Poli | 137/493 |
| 5,409,144 A | | 4/1995 | Brown | 222/185.1 |
| 5,439,143 A | | 8/1995 | Brown et al. | 222/185.1 |
| 5,453,097 A | | 9/1995 | Paradis | 604/247 |
| 5,778,486 A | * | 7/1998 | Kim | 15/339 |

FOREIGN PATENT DOCUMENTS

| | | | | |
|---|---|---|---|---|
| DE | 3941039 A1 | * | 6/1990 | 15/339 |

* cited by examiner

*Primary Examiner*—Theresa T. Snider
(74) *Attorney, Agent, or Firm*—Fay, Sharpe, Fagan, Minnich & McKee, LLP

(57) ABSTRACT

An airflow indicator for a vacuum cleaner is provided. The airflow indicator comprises a housing mounted to a casing of the vacuum cleaner. A piston chamber is defined within the housing. A piston is received in the piston chamber and is movable therein between a first position and a second position. A first port is formed in the housing and communicates with the piston chamber. The first port is open to ambient. A second port is formed in the housing and communicates with the piston chamber. The second port is spaced from the first port and is open to the filter chamber of the vacuum cleaner. A valve is mounted to the housing for obstructing air passage into the piston chamber. The valve includes a diaphragm having a slit that opens in response to a predetermined pressure differential between the first port and the second port.

29 Claims, 5 Drawing Sheets

AIRFLOW INDICATOR

This is a continuation-in-part of Application Ser. No. 09/590,088, filed Jun. 7, 2000, now U.S. Pat. No. 6,467,123, issued Oct. 22, 2002, which is expressly incorporated herein by reference.

BACKGROUND OF THE INVENTION

The present invention relates to an airflow indicator. More particularly, it relates to an airflow indicator that signals when a filter chamber in a vacuum cleaner is full.

Typical vacuum cleaners load a suction motor more and more as a dirt holding means such as a dirt bag, cup, container or the like becomes full. Many vacuum systems use the airflow through the system to cool the motor (particularly in clean air type vacuums). As the dirt holding means of the vacuum becomes more and more full, there is less and less cooling air passing through the motor. The end result can be a reduced motor life due to increased loading.

One attempt at remedying this problem is the use of a hold-open thermostat device which shuts the unit off when the system airflow is not adequate to cool the motor. The hold-open thermostat device then prevents the motor from driving a brush roll of the vacuum cleaner until the motor has cooled down, such as for a period of thirty minutes or more.

There are several reasons that the hold-open thermostat is not a good solution. Once the unit heats up to the trigger point, the consumer can no longer finish cleaning the carpet/surface. The fact that the unit will shut off and remain off for a period of thirty minutes or more is a big inconvenience to the consumer and therefore a product return issue as well.

Other vacuum systems have employed a bleed valve that opens an additional air path to the motor once the airflow through the motor is reduced to a certain level. The reduced (specified) level of airflow corresponds to a vacuum pressure value located at the bleed valve location. After some testing, a pressure value for the desired opening pressure is determined. Using this pressure value, a spring-loaded valve can be designed to open once the pressure reaches the target value.

Currently, many vacuum bleed valve systems use a spring-loaded valve employing a wire form spring. The wire form spring is part of an assembly which has a plunger that usually floats on the top end of the spring. The plunger also interfaces with another surface and commonly creates a seal based on the force of the compressed wire form spring.

Other vacuum manufacturers use valves to indicate airflow to the consumer. Often this is done by displacement of a part once a certain pressure is achieved. For example, some vacuums have used a pin which displaces with the valve head once the open pressure is achieved to indicate that the final filter (often now a HEPA filter) may need replacement on the vacuum.

Although it is not exactly a valve, some vacuum manufacturers use a full bag indicator having a plunger that moves in front of a clear window where it can be observed by the consumer. A change in position of the plunger is due to a pressure difference. The travel of the plunger is due to a small air hole which allows the plunger to move in the direction of the airflow. Since the airflow is so small, the plunger arguably operates on a static pressure difference.

One problem with air valve springs is that they often have low spring rates and large displacements once the desired opening pressure is reached. Larger spring rates are not feasible because a large spring rate usually translates to a system that is too sensitive to variations in assembly and manufacturing methods. With low spring rates, there are many inherent difficulties in achieving a system that performs accurately and precisely. In particular, the wire form spring design approach has many challenges. Often times, variations in plastic part dimensions prevent consistent compression. Variations in the wire form manufacture are costly to minimize and often require the use of precision springs. Even then, the variations expected with regard to the performance of an air valve are large. Often times, the displacement of the valve is different from valve to valve, and this results in different airflow rates into the bleed valve. In fact, many air valve manufacturers have to inspect one hundred percent of all the assemblies they ship.

Another problem with the prior art systems described above is that once the air valve opens, it is often difficult to have the valve close at a desired pressure that is different than the opening value and ideal for customer use. The bleed valve will open under the sealed suction condition, and this often occurs intermittently when the consumer is cleaning furniture or using hand tools with the vacuum. It is desirable to have the valve close back up unless the filter needs cleaning. It is very difficult to try to control the close value of a valve system that uses a wire form spring. Sometimes the valve will remain open due to the airflow through the valve. Finally, friction is always a factor in a system that relies on surface-to-surface travel or displacement.

Accordingly, it has been considered desirable to develop a new and improved airflow indicator which would overcome the foregoing difficulties and others while producing better and more advantageous overall results.

SUMMARY OF THE INVENTION

In accordance with the present invention, a new and improved airflow indicator for a vacuum cleaner is provided.

More particularly, in accordance with this aspect of the invention, the airflow indicator comprises a housing mounted to a casing of a vacuum cleaner. A piston chamber is defined within the housing. A piston is received in the piston chamber and is movable therein between a first position and a second position. A first port is formed in the housing and communicates with the piston chamber. The first port is open to ambient. A second port is formed in the housing and communicates with the piston chamber. The second port is spaced from the first port and is open to a filter chamber of the vacuum cleaner. A valve is mounted to the housing for obstructing air passage into the piston chamber. The valve includes a diaphragm having a slit that opens in response to predetermined pressure differential between the first port and the second port.

According to another aspect of the present invention, a new and improved vacuum cleaner is provided.

More particularly, in accordance with this aspect of the invention, the vacuum cleaner comprises a casing in a filter chamber. The vacuum cleaner further comprises an airflow indicator mounted within the casing. The airflow indicator comprises a housing and a piston chamber defined within the housing. A piston is slidably mounted in the piston chamber and reciprocates between a first position and a second position. A first port is formed in the housing for connecting the piston chamber to ambient. A second port is formed in the housing, and spaced from the first port, for connecting the piston chamber to the filter chamber. A valve is mounted to the housing and is selectively openable in response to a predetermined pressure differential between ambient and the filter chamber causing an air stream to pass from the first port into the piston chamber. The air stream urges the piston toward the second position.

According to still another aspect of the present invention, a method of indicating when a debris collecting filter chamber of a vacuum cleaner is filling up is provided.

More particularly, in accordance with this aspect of the invention, the method comprises the steps of providing an airflow passage between the chamber and ambient. Flow in the airflow passage is obstructed with a normally closed valve. The filter chamber is filled with debris thereby causing a predetermined pressure differential between atmosphere and the filter chamber. The valve is opened thereby opening the airflow passage and causing air to flow from ambient towards the filter chamber. The air flowing towards the filter chamber is used to indicate that the container is filling up.

According to still yet another aspect of the present invention, a new and improved airflow indicator for a vacuum cleaner is provided.

More particularly, in accordance with this aspect of the invention, the airflow indicator comprises a casing having a filter chamber. An air path on the casing leads from ambient into the filter chamber. An indicator is movably mounted in the air path. A valve is mounted in the air path for selectively allowing a flow of air through the air path. The valve comprises a diaphragm formed of a resilient material. The diaphragm includes a slit which opens when an air pressure differential between ambient and the filter chamber exceeds a predetermined limit.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
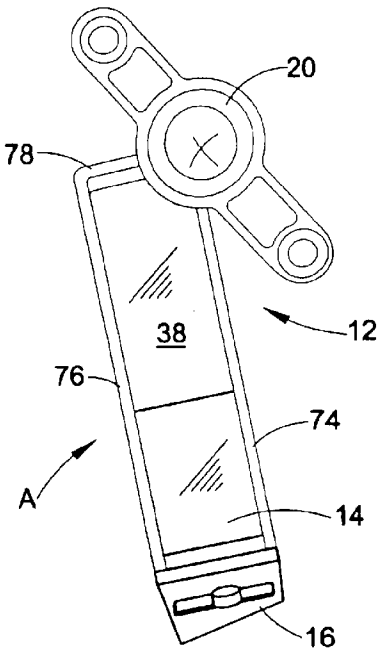
FIG. 1 is a perspective view of an airflow indicator in accordance with a preferred embodiment of the present invention.

Referring now to the drawings, wherein the showings are for purposes of illustrating a preferred embodiment of this invention only and not for purposes of limiting same, FIG. 1 shows a airflow indicator A according to the preferred embodiment of the present invention.

Figure 2:
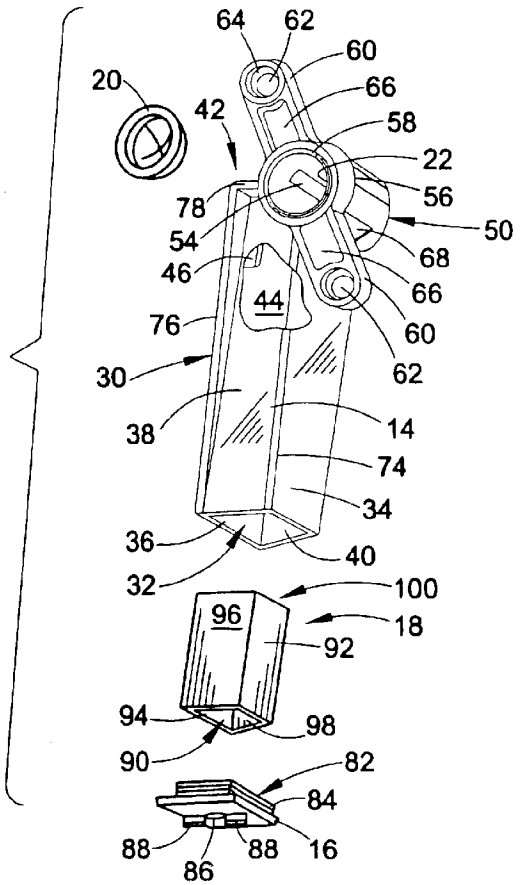
FIG. 2 is an exploded perspective view of the airflow indicator of FIG. 1.

The airflow indicator A includes a housing 12 having a body 14 and a cap 16. With reference now to FIG. 2, a piston 18 is operatively received within the housing 12 as will be discussed in more detail below. A diaphragm or bleed valve 20 is mounted to the housing 12 adjacent an air outlet 22. The housing body 14, the cap 16, and the piston 18 can be fabricated from plastic material.

With continued reference to FIG. 2, the housing body 14 can comprise a generally hollow trapezoidal or prismatic portion 30 having an open end or end opening 32. The trapezoidal portion 30 is comprised of a plurality of elongated sides including parallel sides 34,36, a front side 38, and a rear side 40. Unless otherwise indicated, the terms front and rear are used in this specification only to indicate orientations of components or parts in relation to the air outlet 22 and are not for purposes of limiting the invention. Thus, the front side 38 is located in closer proximity to the air outlet 22 than is the rear side 40.

The front side 38 connects between front edges of the parallel side 34, 36 and is perpendicular to the parallel sides 34,36. Further, the front side 38 is parallel to a general plane of the air outlet 22. The rear side 40 connects between rear edges of the parallel sides 34,36 and, because the parallel side 36 is greater in width than the parallel side 36, is not perpendicular to the parallel sides 34,36 or parallel to the front side 38. A closed end 42 connects to end edges of the sides 34–40 opposite the end opening 32. The hollow area of the trapezoidal portion 30 defines a piston cavity or chamber 44. Of course, other cross sectional shapes, such as a circle or a square could also be used for the piston chamber, depending on the shape of the housing body 14. To some extent, that is dependant on the space available in the casing of the vacuum cleaner. A stop means or longitudinal rib 46 that is parallel to the elongation of the trapezoidal portion 30 extends into the piston chamber 44 from the wider parallel side 36 adjacent the closed end 42.

The housing body 14 also comprises a circular valve or cup portion 50. The cup portion 50 is partially imbedded into the trapezoidal portion 30. More specifically, the cup portion 50 partially intersects or overlaps the trapezoidal portion 30 where, without the cup portion 50, the parallel side 34 and the closed end 42 would form a corner junction. The cup portion 50 includes a generally cylindrical chamber that is in communication with the piston chamber 44 through a connecting opening 54 located adjacent a base 56 of the cup portion 50. Opposite the base, an open end of the cup portion 50 forms the air outlet or port 22 of the airflow indicator A.

The air outlet 22 is also used to seat the bleed valve 20 and may be additionally referred to herein as a valve opening. A raised annular radius 58 is provided around and adjacent to the valve opening 22 to facilitate the seating of the valve 20 in the valve opening 22. A pair of opposing wing brackets 60 extend outwardly from the cup portion 50 adjacent the valve opening 22. The wing brackets 60 are positioned in an angular orientation relative to the elongation of the trapezoid prism portion 30. Each of the wing brackets 60 includes a fastener opening 62 for mounting the brackets 60 to a vacuum cleaner B (FIG. 5), a counterbore 64 for receiving a fastener head, a rectangular recess 66 and a support web 68.

A mounting or support frame is disposed on the front side 38 of the housing body. It can comprise elongated tapered legs 74,76 and closed end leg 78. The legs 74,76,78 protrude frontward from the front side 38. The leg 76 tapers from adjacent the intersection of the side 36 and the closed end 42 to the end opening 32 and along a corner between the side 36 and the front side 38. The leg 74 tapers from adjacent the intersection of the cup portion 50 and the side 34 to the end opening 32 and along a corner between the side 34 and the front side 38. The end leg 78, without any taper, connects between the leg 76 and the cup portion 50 along a corner between the front side 38 and the closed end 42.

The trapezoid-shaped cap 16 plugs the end opening 32 thereby closing the piston chamber 44. The cap 16 includes a raised wall portion 82 having ribs 84 extending around the perimeter of the raised wall portion 82. The raised wall portion 82 is shaped and sized for snugly and securely engaging interior surfaces of the sides 34–40. The cap 16 includes a centrally located orifice, port, or air inlet 86 that permits air communication with the piston chamber 44. A pair of upstanding ribs 88 extend outwardly from the air inlet 86 in the direction of the parallel sides 34,36.

The piston 18 can be trapezoidal or prismatic in shape having one open end 90, also referred to herein as an apertured second face. The piston 18 is slidably received within the piston chamber 44. Naturally it has a cross-sectional area that substantially matches a cross-sectional area of the piston chamber 44, whether that be trapezoidal, square, circular, etc. However, the piston 18 is abbreviated relative to the elongation of the piston chamber 44 and is able to freely slide or reciprocate within the piston chamber 44 between the end opening 32 and one end of the rib 46 adjacent the closed end 42.

The piston 18, like the trapezoidal portion 30, is comprised of a plurality of parallelogram-shaped sides including parallel piston sides 92,94, a front piston side 96, and a rear piston side 98. The front piston side 96 connects between front edges of the parallel piston sides 92,94 and is perpendicular to the parallel sides 92,94. The rear piston side 98 connects between rear edges of the parallel piston sides 92,94 and, because the parallel piston side 94 is greater in width than the parallel piston side 92, is not perpendicular to the parallel piston sides 92,94 or parallel to the front piston side 96. A solid first face or closed piston end 100 connects to end edges of the sides 92–98 opposite the apertured second face 90. The hollow area of the piston 18 defines an interior cavity. The closed piston end 100 can include an orifice or opening (not shown) to the interior piston cavity. This orifice provides a relief passage for any air trapped within or forced into the interior cavity.

Figure 3:
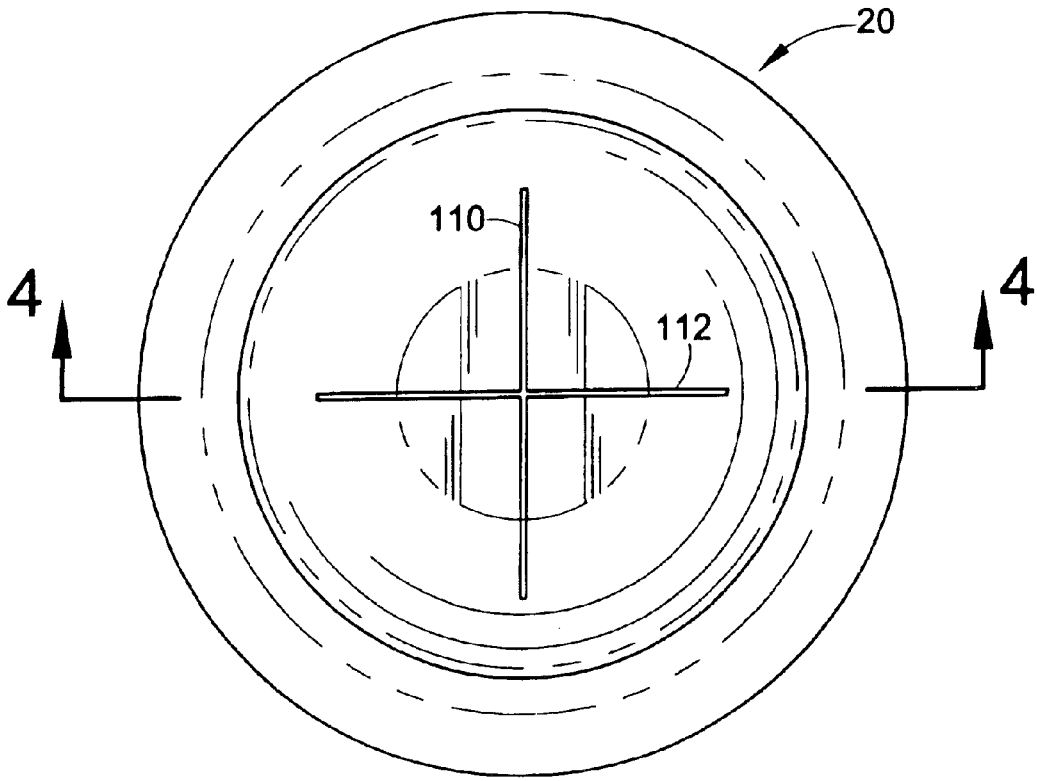
FIG. 3 is an enlarged top plan view of a diaphragm valve of the airflow indicator of FIG. 1, illustrating a cross slit in the valve.
Figure 4:
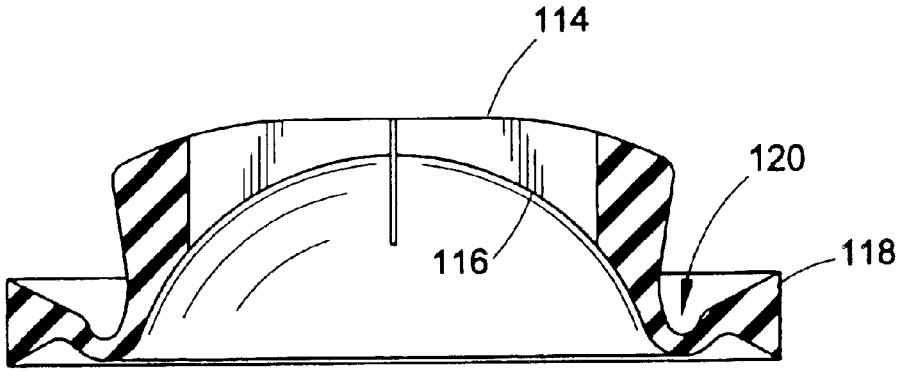
FIG. 4 is a side elevational view, in cross section, of the valve of FIG. 3.

The bleed valve 20, as discussed briefly above, is seated within the air outlet 22. With reference to FIG. 3, the bleed 20 has cross slits 110, 112 which intersect one another at approximately right angles. With reference to FIG. 4, the bleed valve 20 includes a convex side 114 and a concave side 116. Further, the bleed valve 20 includes an annular locating rib 118 defining an annular groove 120. The annular groove 120 receives the raised annular radius 58 (FIG. 2) of the housing 12. The locating rib 118 permits the valve 20 to be pinched between the housing 12 and a bag housing as will be discussed in further detail below.

The bleed valve 20 can be fabricated from a conventional thermoplastic resilient material. In one embodiment, the valve 20 is fabricated from a silicon composite, including silicon-polymer composites, such as a silicone rubber. The use of a silicon composite bleed valve, available from Liquid Molding Systems, Inc. of 800 South Jefferson Avenue, Midland, Mich. 48640-5386, is common in liquid applications. The bleed valve 20 is designed for airflow application. It should be appreciated that the bleed valve 20 could be made from other conventional resilient materials, is so desired.

Figure 5:
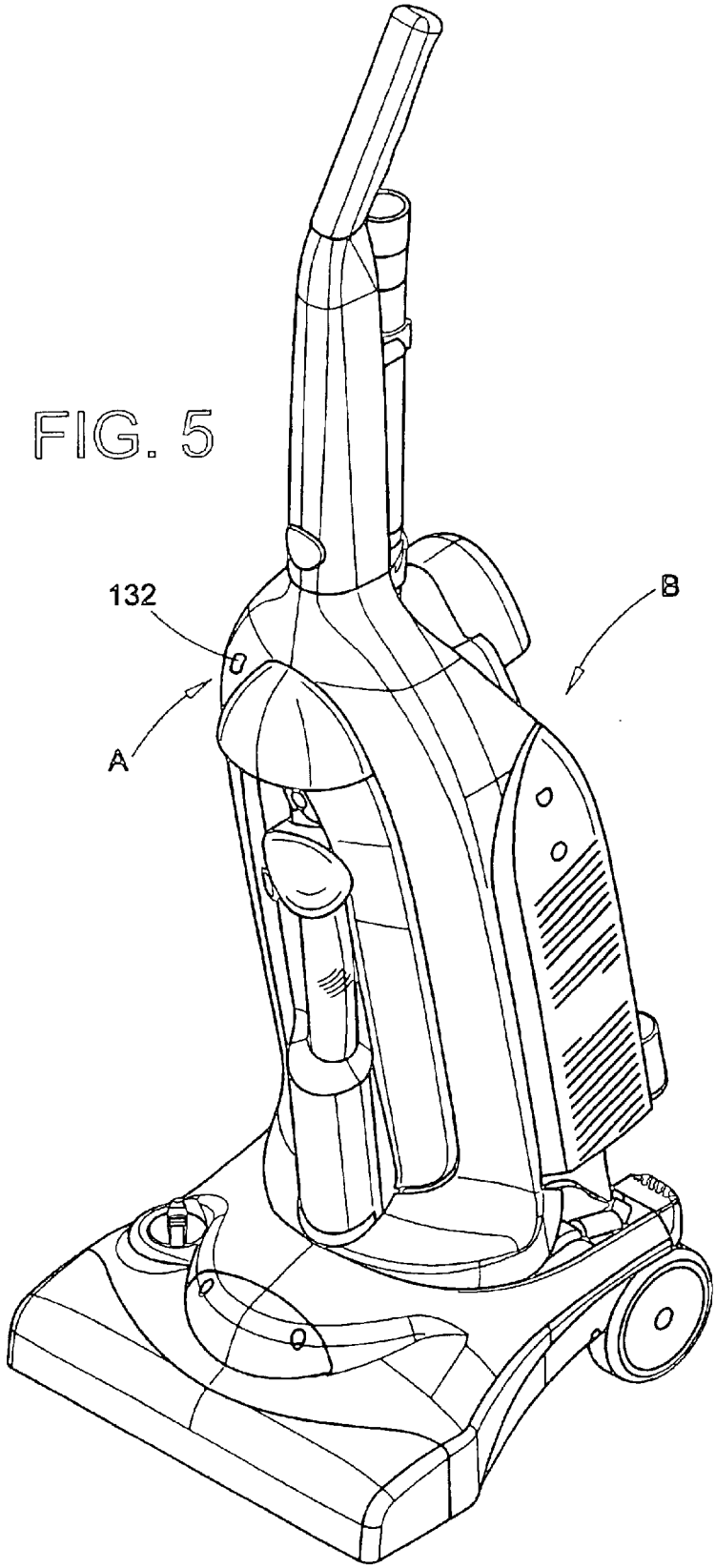
FIG. 5 is a front elevational view of a vacuum cleaner with the airflow indicator of FIG. 1 mounted therein.
Figure 6:
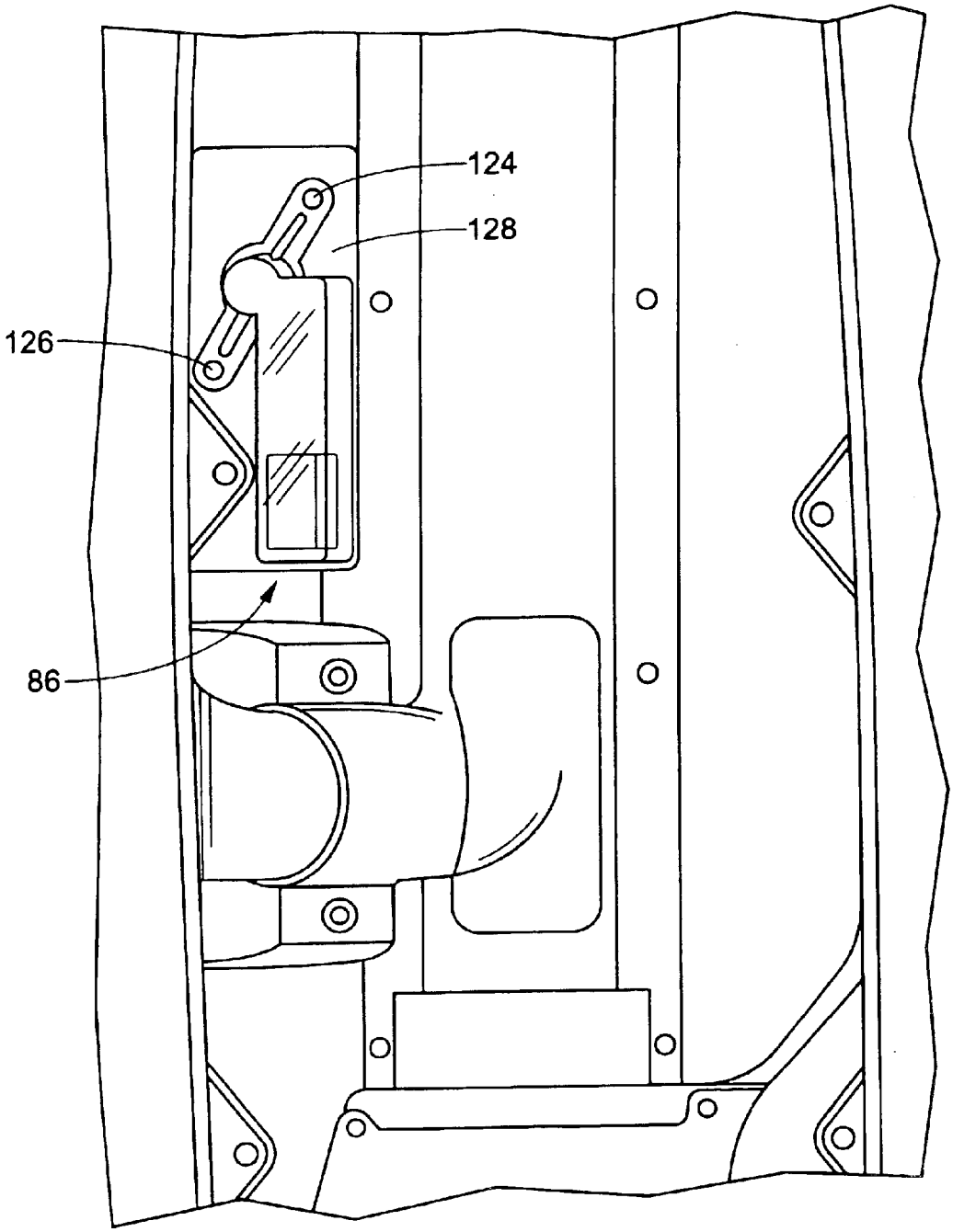
FIG. 6 is an enlarged partial front elevational view of the vacuum cleaner of FIG. 5 shown with a cover removed to reveal the airflow indicator mounted to a vacuum cleaner casing.
Figure 7:
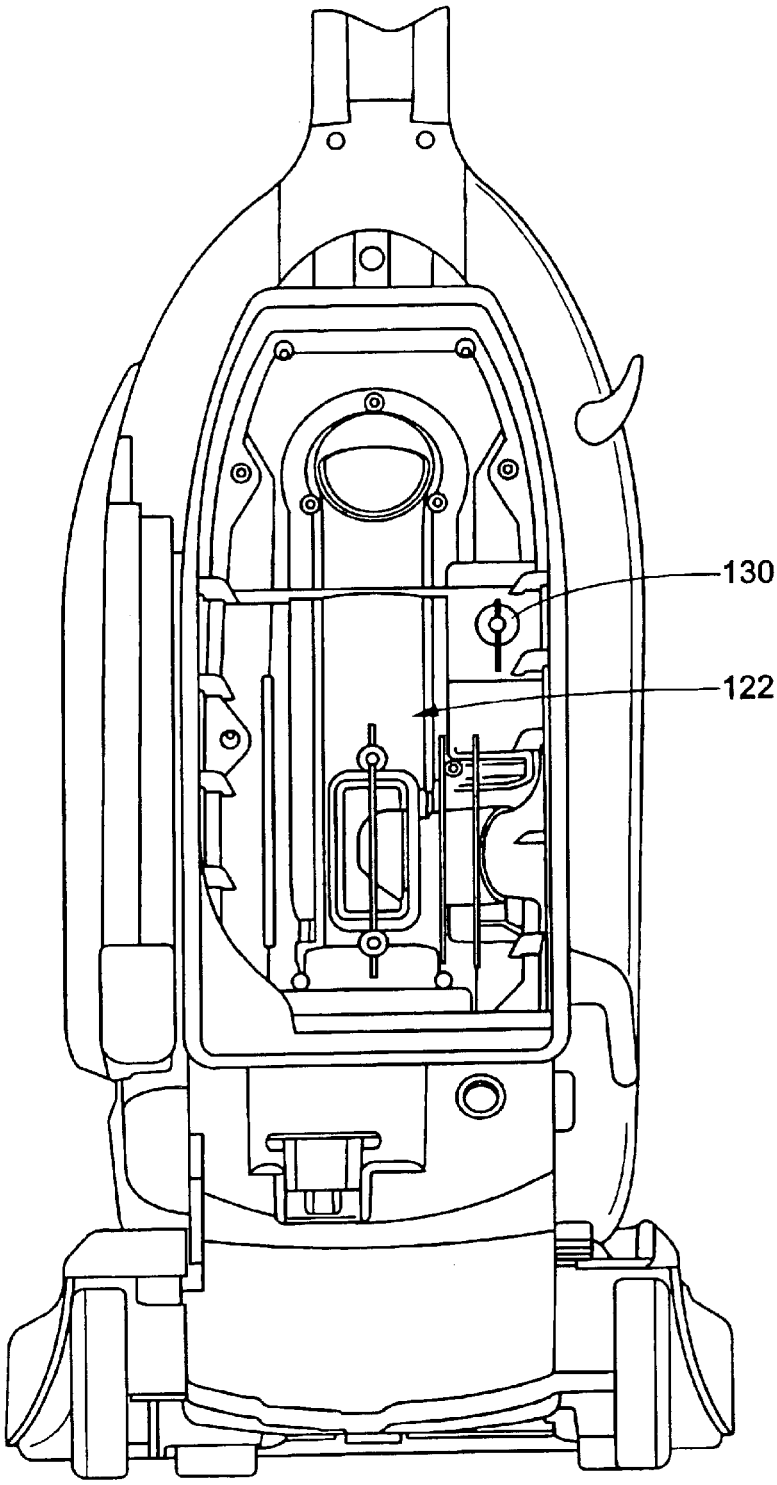
FIG. 7 is a rear elevational view of the vacuum cleaner of FIG. 5 shown with a rear cover removed to reveal a filter chamber opening for communicating with a second port of the airflow indicator.

With reference to FIG. 5, a vacuum cleaner B with the airflow indicator A is provided. The vacuum cleaner B includes a conventional suction motor and fan assembly (not shown) for creating a vacuum or suction pressure for pulling dirt and debris into a vacuum filter chamber 122 (FIG. 7) and through a filter element (not shown). The airflow indicator A is positioned behind and above a filter bag or other dirt holding member in the vacuum cleaner. Further, the airflow indicator A is positioned within a vacuum cover near a base of the handle portion. However, this device may be used on any vacuum cleaner or other airflow device that uses airflow during normal operation. With reference to FIG. 6, the vacuum cleaner B is shown with a cover removed to reveal the entire airflow indicator A operatively mounted to a casing 128 of the vacuum cleaner B. More specifically, a pair of fasteners 124,126 are received in the fastener openings 62 for securely mounting the airflow indicator A to the vacuum casing 128. The valve 20 is pinched between the cup portion 50 and the casing 128 of the vacuum cleaner B. The air inlet 86 is open to atmosphere and the air outlet 22 is mounted to the vacuum cleaner B such that it communicates with the vacuum filter chamber (FIG. 7). With reference to FIG. 7, a filter chamber opening 130 communicates with the air outlet 22. The filter chamber 122 is defined between a portion of the vacuum casing and a removed rear cover (not shown).

During normal operation of the vacuum cleaner B, gravity urges the piston 18 of the air flow indicator A toward a position adjacent the air inlet 86 due to the orientation of the airflow indicator A relative to the vacuum cleaner B and gravity when the vacuum cleaner B is used in a normal manner. The bleed valve 20 obstructs communication between the piston chamber 44, or air inlet 86, and the vacuum filter chamber 122. More specifically, the cross slits 110,112 of the bleed valve 20 form a hermetic seal when in a resting or loaded state between the air inlet 86 and the vacuum filter chamber 122. The valve 20 remains in a resting state as long as a pressure differential between the piston chamber 44 (ambient or atmosphere) on the convex side 114 of the valve 20 and the filter chamber 122 on the concave side 116 of the valve 20 remains below a predetermined amount. While the valve 20 remains closed, virtually no atmospheric air enters the piston chamber 44 through the air inlet 86. As a result, gravity maintains the piston 18 in a position adjacent the air inlet 86.

The pressure differential between atmosphere and the vacuum filter chamber 122 generally remains below the predetermined amount during normal usage of the vacuum cleaner B as long as the vacuum filter chamber 122 is not full and suction airflow through the filter is unobstructed. However, should the vacuum cleaner filter become clogged or the vacuum filter chamber 122 become filled, the suction pressure within the vacuum filter chamber 122 will appreciably increase. The increased suction pressure will cause a pressure differential over the aforementioned predetermined amount thereby causing the cross slits 110,112 of the valve 20 to open. As a result, air at atmospheric pressure will rush into the opening 86 through the piston chamber 44 causing the piston 18 to move against gravity toward a second position adjacent the outlet 22.

More specifically, once the difference in pressure between the vacuum filter chamber 122 and atmosphere exceeds the predetermined amount, the cross slits 110,112 will displace and open up to a specified orifice size (i.e., ⅜" diameter) causing atmospheric air to pass through the piston chamber 44 and enter the filter chamber 122. The air passing through the valve 20 has the effect of moving the piston 18 against gravity toward the second position adjacent to the outlet 22 thereby indicating that the valve 20 is open.

The valve 20 remains open until a specified sealing pressure is achieved in the filter chamber such as when the pressure differential between the filter chamber and atmosphere drops below approximately 42 inches of $H_2O$. Once the sealing pressure is achieved, the valve 20 closes and reseals. Thus, the valve is kept from staying open and reducing the vacuum cleaner's cleaning power unless it is functionally required. Furthermore, oscillation of the valve 20 is prevented. The variance between the valve opening pressure differential (approximately 56 inches of $H_2O$) and the valve closing pressure differential (approximately 42 inches of $H_2O$) creates a hysteresis effect. Thus, once the valve 20 opens, it remains open to allow a significant amount of ambient air to enter the filter chamber 122 before closing. If the opening and closing pressure values were the same or too close, the valve 20 would undesirably oscillate between an open and closed state.

The piston 18 serves as a dynamic performance indicator. Once the valve 20 experiences a certain pressure differential as determined by a pressure tap, i.e., approximately 56 inches of $H_2O$, then the valve 20 opens, causing air from atmosphere to flow through the piston chamber 44 moving the piston 18 to the second position which indicates to a user that it is time to check the vacuum cleaner B for obstructions in the airflow path thereof including the dust bag, filter or full condition of the vacuum bag.

With reference to FIG. 1, at least a portion of the housing body 14 is transparent adjacent the outlet 22. Further, with reference to FIG. 5, the vacuum cover includes a transparent portion or opening 132 for viewing the transparent portion of the housing body 14. Thus, by moving the piston 18 into the transparent portion of the housing body 14, a user is simply informed that the vacuum cleaner B needs attention. The motion or moved piston is used to indicate a full dirt bag, dirty inlet filter, dirty final filter (via use of positive pressure instead of vacuum pressure), a clog, or perhaps even a broken belt (based on positioning and pressure differences). Of course, the entire housing body 14 or a large portion thereof could be made of conventional transparent plastic and the vacuum cover could be made to reveal the entire transparent portion to show not only when the piston 18 is fully in the second position but also when the piston is moving or has moved toward the second position.

In an alternate embodiment, the valve 20 can be reversed so that the convex side 114 is adjacent the vacuum filter chamber and the concave side 116 is adjacent the piston chamber 44. In another alternative, the slits 110,112 could be rearranged, added to, or partially eliminated to change the predetermined pressure differential required to open the valve 20. In still another alternative, the bleed valve 20 can be used in a vacuum cleaner B without the airflow indicator piston 18. The use of the bleed valve 20 without the piston 18 still eliminates the need for a thermostat for the motor and provides a cost reduction in the manufacture of the vacuum cleaner.

The invention has been described with reference to a preferred embodiment. Obviously, alterations to modifications will occur to other upon a reading and understanding of this specification. It is intended to include all such modifications and alterations insofar as they come within the scope of the appended claims or the equivalents thereof.

Having thus described the invention, it is claimed:

1. An airflow indicator for a vacuum cleaner, comprising:

a housing mounted to a casing of the vacuum cleaner;

a piston chamber defined within the housing;

a piston received in the piston chamber and movable therein between a first position and a second position;

a first port formed in the housing and communicating with the piston chamber, the first port being open to ambient;

a second port formed in the housing and communicating with the piston chamber, the second port being spaced from the first port and being open to a filter chamber of the vacuum cleaner; and a valve mounted to the housing in one of the first port, the second port and the piston chamber for obstructing air passage into the piston chamber from one of the first port and the second port, the valve including a diaphragm having a slit that opens in response to a predetermined pressure differential between the first port and the second port.

2. The airflow indicator of claim 1 wherein said slit comprises a cross-slit.

3. The airflow indicator of claim 1 wherein the predetermined pressure differential occurs when the filter chamber is relatively full of debris creating a low pressure relative to ambient.

4. The airflow indicator of claim 1 wherein the piston moves from the first position toward the second position when the diaphragm is open.

5. The airflow indicator of claim 1 wherein at least a portion of the housing is transparent to permit viewing of the piston when the piston is in at least one of the second position and a transition toward the second position.

6. The airflow indicator of claim 1 wherein said housing is so oriented that gravity urges the piston toward the first position.

7. The airflow indicator of claim 1 wherein the slit remains closed at a pressure differential of less than about 56 inches of $H_2O$.

8. The airflow indicator of claim 1 wherein the diaphragm is fabricated from a material including silicon.

9. The airflow indicator of claim 1 wherein the piston includes a solid first face and an apertured second face leading to an interior cavity.

10. The airflow indicator of claim 1 wherein the piston chamber is a generally trapezoid-shaped prism and the piston is similarly shaped such that the cross-sectional area of the piston substantially fills the cross-sectional area of the piston chamber.

11. The airflow indicator of claim 1 wherein the second port is oriented approximately normal to at least one of a longitudinal axis of the piston chamber and the first port.

12. A vacuum cleaner having a vacuum source comprising:

a casing and a filter chamber; and an airflow indicator mounted within the casing, the airflow indicator comprising:

a housing, a piston chamber defined within the housing, a piston slidably mounted in the piston chamber and reciprocating between a first position and a second position, a first port formed in the housing for connecting the piston chamber to ambient, a second port formed in the housing, and spaced from the first port, for connecting the piston chamber to the filter chamber, a valve mounted to the housing in one of the first port, the second port and between the first and second ports, the valve selectively openable in response to a predetermined pressure differential between ambient and the filter chamber causing an air stream to pass from the first port into the piston chamber, the air stream urging the piston towards the second position.

13. The vacuum cleaner of claim 12 wherein the airflow indicator housing includes a transparent portion for viewing the piston in at least one of the second position and movement of the piston toward the second position.

14. The vacuum cleaner of claim 12 wherein the casing includes a viewing opening for viewing the piston in at least one of the second position and movement toward the second position.

15. The vacuum cleaner of claim 12 wherein said piston is urged toward the first position.

16. The vacuum cleaner of claim 15 wherein gravity urges said piston towards the first position.

17. The vacuum cleaner of claim 12 wherein said piston comprises a solid first face and a second face including an opening leading to an interior cavity.

18. A method of indicating when a debris collecting filter chamber of a vacuum cleaner is filling up, the method comprising the steps of:

providing an airflow passage between the chamber and atmosphere;

obstructing flow in the airflow passage with a normally closed valve;

filling the filter chamber with debris thereby causing a predetermined pressure differential between atmosphere and the filter chamber;

opening the valve thereby opening the airflow passage and causing air to flow from atmosphere towards the filter chamber; and using the air flowing towards the filter chamber to visually indicate that an associated container is filling up by moving a piston within the airflow passage from a resting position toward a positive airflow position which indicates that the associated container is filling up.

19. The method of claim 18 further comprising the step of urging the piston toward the resting position.

20. The method of claim 19 wherein the step of urging the piston toward the resting position comprises the subsidiary step of:

orienting the piston relative to gravity so that gravity urges the piston toward the resting position.

21. The method of claim 18 wherein the step fusing the air flowing from atmosphere to the associated chamber comprises the subsidiary steps of:

providing said piston within a piston chamber defined by a housing mounted to a casing of the vacuum chamber; and providing at least a transparent portion of said housing adjacent said positive airflow position to permit viewing of said piston when in said positive airflow position.

22. The method of claim 18 wherein the step of opening the valve comprises the subsidiary steps of:

providing said valve as a diaphragm having a slit that opens in response to said predetermined pressure differential; and opening said valve when said predetermined pressure differential occurs.

23. An airflow indicator for a vacuum cleaner including a casing having a filter chamber, said airflow indicator comprising:

an air path on the casing leading from ambient into said filter chamber;

an indicator movably mounted in said air path;

a valve mounted in said air path for selectively allowing a flow of air through said air path, said valve comprising a diaphragm formed of a resilient material, said diaphragm including a slit which opens when an air pressure differential between ambient and said filter chamber exceeds a predetermined limit.

24. The indicator of claim 23 wherein the slit comprises a pair of intersecting slits.

25. The indicator of claim 23 wherein said diaphragm comprises a material including silicon.

26. The indicator of claim 23 wherein said diaphragm is approximately disc shaped.

27. The indicator of claim 26 wherein said disc shaped diaphragm includes a bowed central portion.

28. The indicator of claim 26 wherein said disc shaped diaphragm includes a ribbed peripheral portion.

29. The indicator of claim 23 wherein said diaphragm slit opens at an air pressure differential of greater than about 56 inches of $H_2O$.

* * * * *